US007080768B2

(12) United States Patent
Marks

(10) Patent No.: US 7,080,768 B2
(45) Date of Patent: Jul. 25, 2006

(54) SPRING ENERGIZED DESKTOP STAPLER

(75) Inventor: Joel S. Marks, Sherman Oaks, CA (US)

(73) Assignee: WorkTools, Inc., Chatsworth, CA (US)

( * ) Notice: Subject to any disclaimer, the term of this patent is extended or adjusted under 35 U.S.C. 154(b) by 0 days.

(21) Appl. No.: 10/924,688

(22) Filed: Aug. 23, 2004

(65) Prior Publication Data

US 2005/0098604 A1 May 12, 2005

Related U.S. Application Data

(60) Provisional application No. 60/519,027, filed on Nov. 10, 2003.

(51) Int. Cl.
*B25C 5/00* (2006.01)

(52) U.S. Cl. ..... 227/120; 227/119; 227/125; 227/126; 227/134

(58) Field of Classification Search ..... 227/119, 227/120, 125, 126, 132, 134
See application file for complete search history.

(56) References Cited

U.S. PATENT DOCUMENTS

| | | | | |
|---|---|---|---|---|
| 1,956,174 | A | 4/1934 | Maynard | |
| 2,059,021 | A * | 10/1936 | Pankonin | 227/122 |
| 2,131,473 | A * | 9/1938 | Drypolcher | 227/134 |
| 2,142,782 | A | 1/1939 | Gillette | |
| 2,218,794 | A | 10/1940 | Kilbride | |
| 2,271,479 | A | 1/1942 | Gambao | |
| 2,421,429 | A | 6/1947 | Obstfeld | |
| 2,657,384 | A | 11/1953 | Boroughs | |
| 2,726,391 | A | 12/1955 | Piblad | |
| 2,733,440 | A | 2/1956 | Jenny | |
| 2,798,219 | A * | 7/1957 | Maynard | 227/134 |
| 2,884,636 | A | 5/1959 | Abrams | |
| D186,342 | S | 10/1959 | Marano | |
| 2,915,753 | A | 12/1959 | Ruskin | |
| 3,034,128 | A | 5/1962 | Robbins | |
| 3,630,428 | A | 12/1971 | Olney et al. | |
| 3,758,016 | A | 9/1973 | Olney et al. | |

(Continued)

FOREIGN PATENT DOCUMENTS

| | | |
|---|---|---|
| DE | 2856-621 | 12/1978 |

(Continued)

OTHER PUBLICATIONS

Marks, Joel S., Application for U.S. Letters U.S. Appl. No. 10/443,854, filed May 23, 2003.

*Primary Examiner*—Scott A. Smith
*Assistant Examiner*—Nathaniel Chukwurah
(74) *Attorney, Agent, or Firm*—Paul Y. Feng; Fulwider Patton LLP

(57) ABSTRACT

A desktop stapler includes an automatic opening staple track whereby when the stapler is opened by pivoting the body about the base, the track is de-latched by ribs of the base, and the track slides out from a chamber within the body. The stapler includes a track alignment system that holds the front of the body precisely over the anvil by use of forward and rear torque arm contact areas between the base and track. The stapler also features a striker bottom edge that is shaped to follow the curved shape of the anvil so that the striker may enter the anvil recess without impacting the anvil. A staple chamber in the stapler has staple exit ribs that allow only one staple at a time to be ejected from the staple chamber.

21 Claims, 5 Drawing Sheets

U.S. PATENT DOCUMENTS

| | | | | |
|---|---|---|---|---|
| D243,148 | S | | 1/1977 | Levin |
| 4,040,556 | A | * | 8/1977 | Dahle ..... 227/120 |
| 4,156,499 | A | | 5/1979 | Frank |
| 4,206,863 | A | | 6/1980 | Savino |
| 4,463,890 | A | | 8/1984 | Ruskin |
| 4,546,909 | A | | 10/1985 | Ebihara |
| 4,598,852 | A | | 7/1986 | Olesen |
| 4,666,075 | A | | 5/1987 | Olesen |
| 4,795,073 | A | | 1/1989 | Yamamoto et al. |
| 4,811,884 | A | | 3/1989 | Sato |
| 5,004,142 | A | | 4/1991 | Olesen |
| 5,356,063 | A | | 10/1994 | Perez |
| 5,699,949 | A | | 12/1997 | Marks |
| 5,715,982 | A | | 2/1998 | Adachi |
| 5,765,742 | A | * | 6/1998 | Marks ..... 227/132 |
| 5,816,470 | A | | 10/1998 | Plato et al. |
| D413,239 | S | | 8/1999 | Lovegrove et al. |
| 5,931,364 | A | | 8/1999 | Dennis |
| 5,979,736 | A | | 11/1999 | Edeholt |
| 5,988,478 | A | | 11/1999 | Marks |
| 6,145,728 | A | | 11/2000 | Marks |
| 6,152,347 | A | | 11/2000 | Wilson et al. |
| D437,754 | S | | 2/2001 | Jacquet |

FOREIGN PATENT DOCUMENTS

| | | | |
|---|---|---|---|
| DE | 19712849 | A1 | 10/1998 |
| DE | 10138447 | A1 | 7/2003 |
| DE | 10225816 | A1 | 1/2004 |
| GB | 2032327 | A | 5/1980 |
| GB | 2229129 | A | 9/1990 |

* cited by examiner

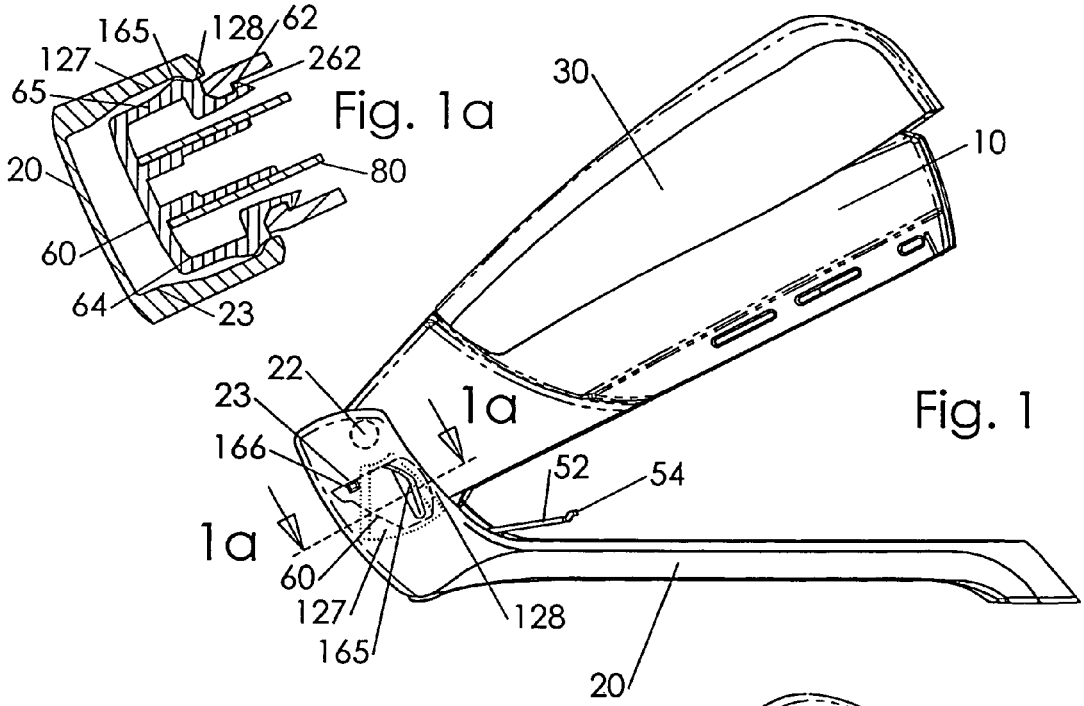
Fig. 1a
Fig. 1
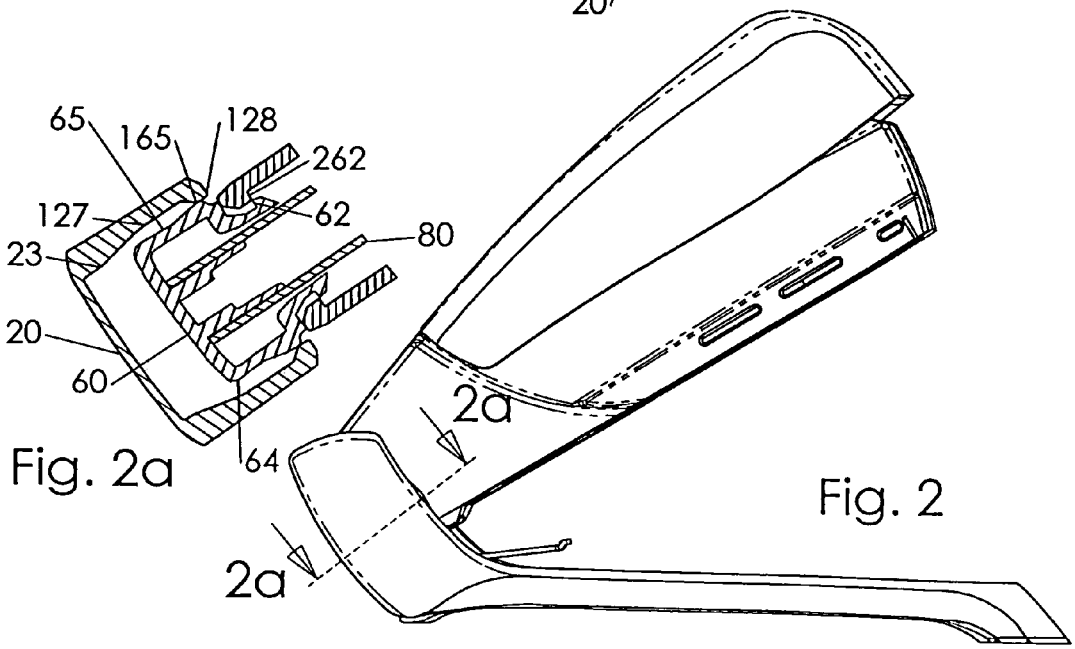
Fig. 2a
Fig. 2

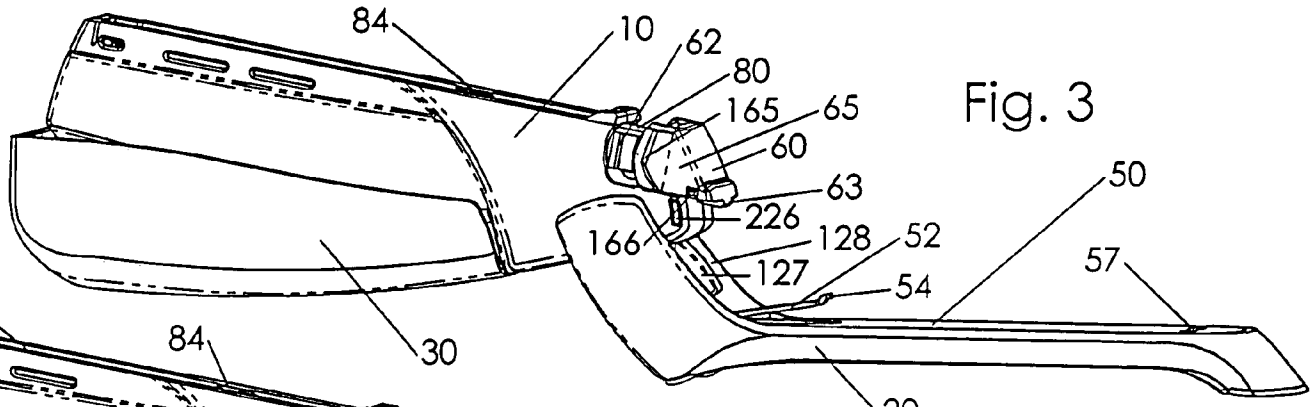
Fig. 3
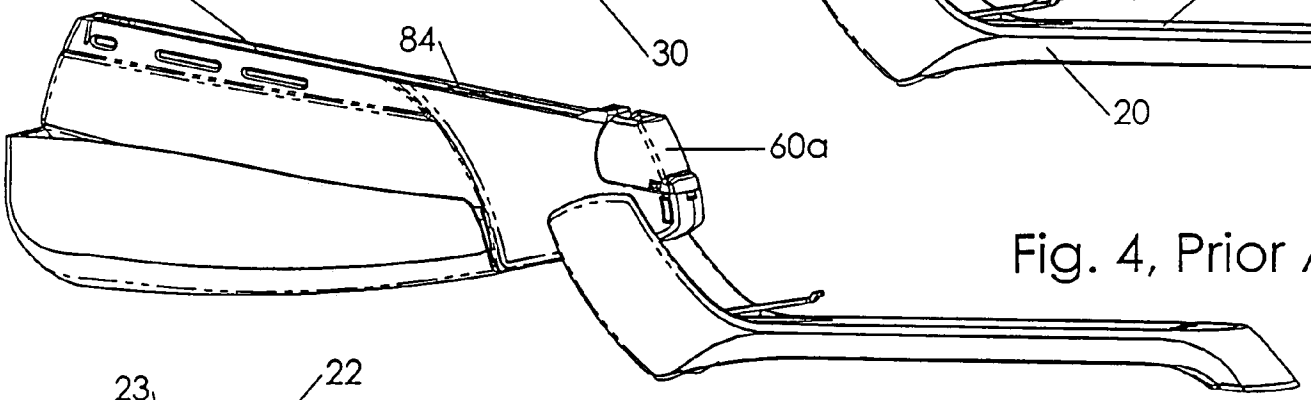
Fig. 4, Prior Art
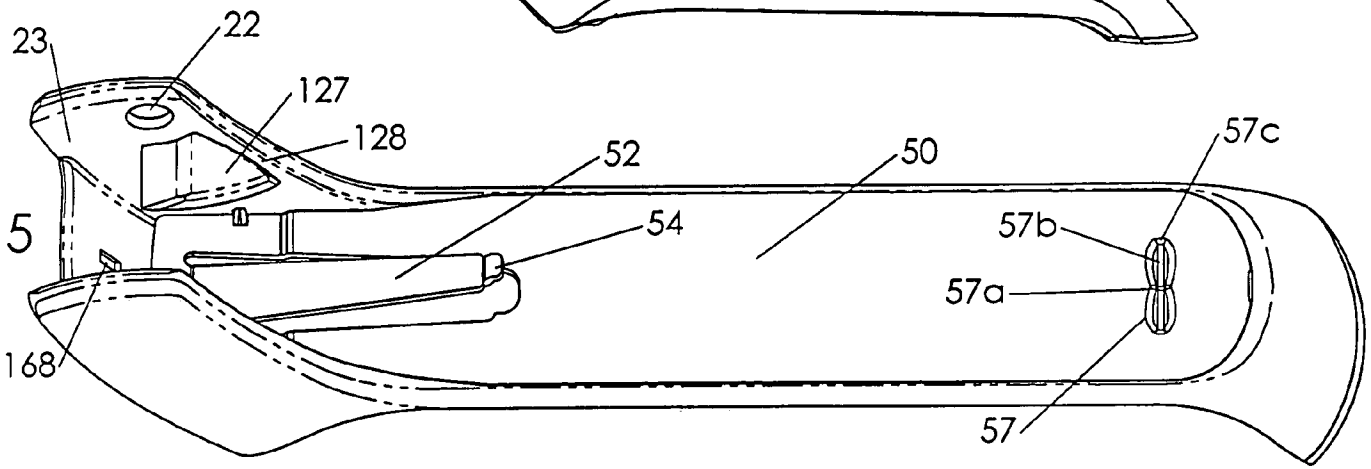
Fig. 5

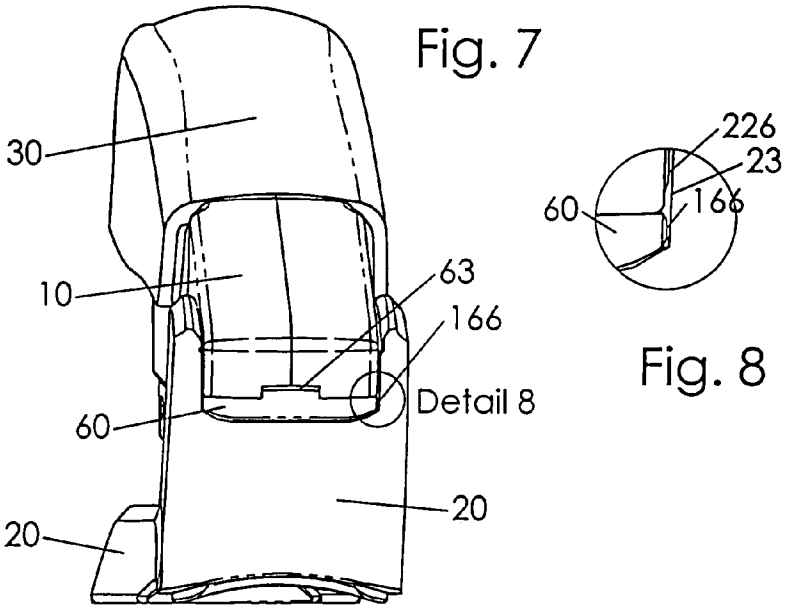
Fig. 7
Fig. 8
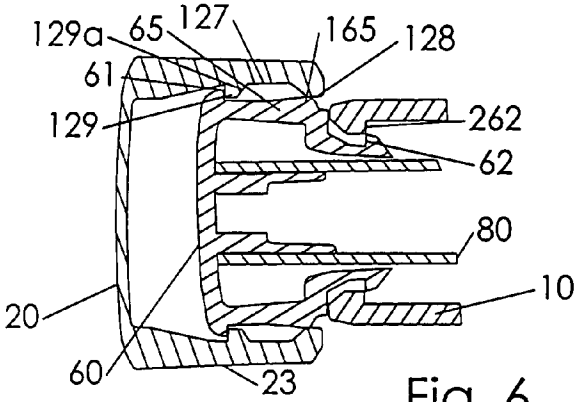
Fig. 6
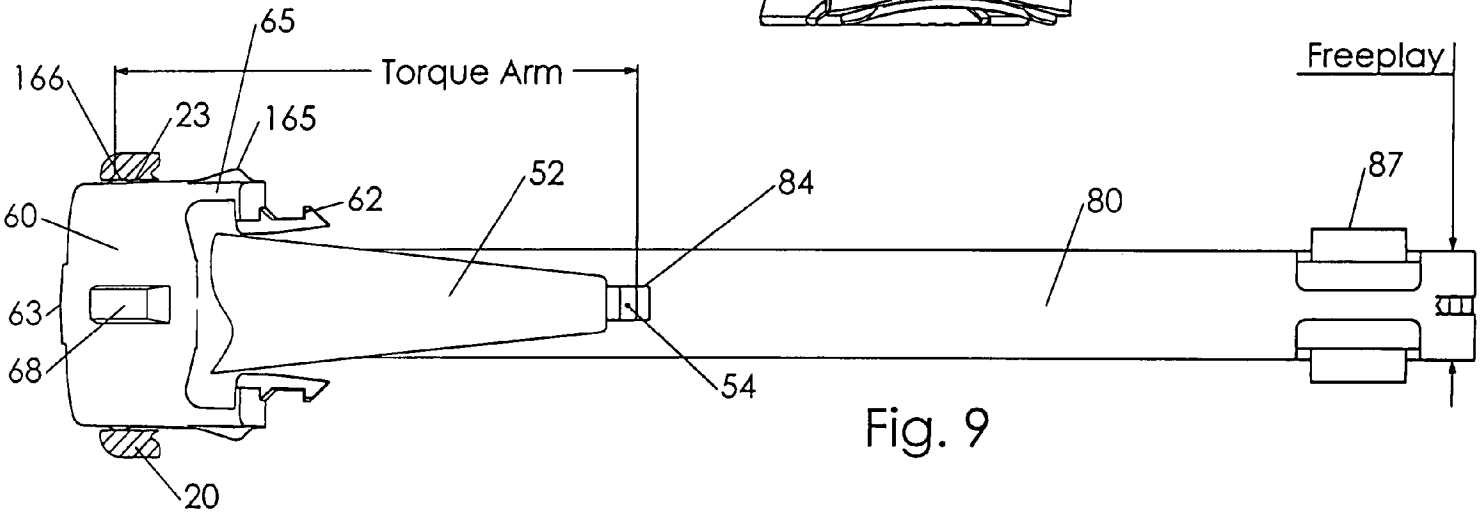
Fig. 9

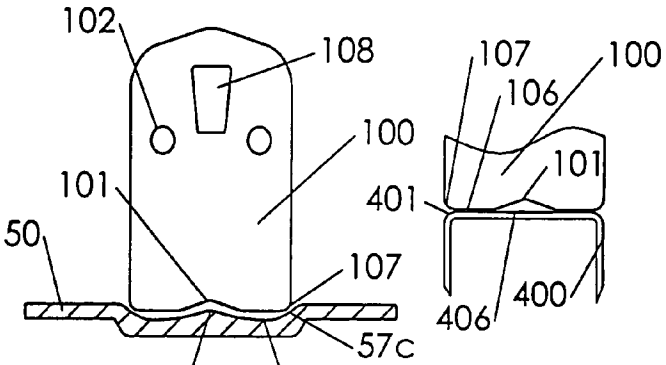
Fig. 13
Fig. 12
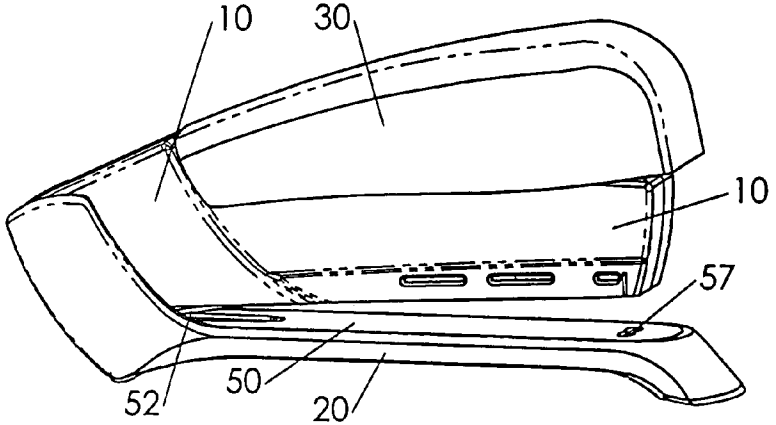
Fig. 10
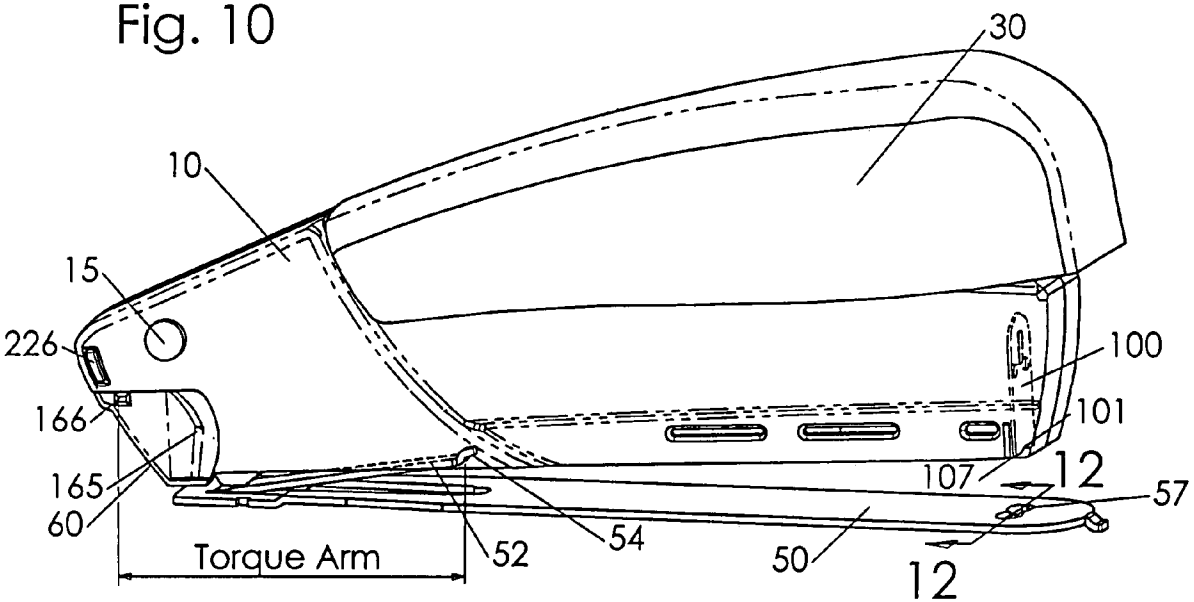
Fig. 11

SPRING ENERGIZED DESKTOP STAPLER

CROSS-REFERENCE TO RELATED APPLICATIONS

This application claims the benefit of priority from U.S. Provisional Application No. 60/519,027, filed Nov. 10, 2003, which is hereby incorporated by reference.

FIELD OF THE INVENTION

The present invention relates to desktop staplers. More precisely the present invention discloses improvements to a spring-actuated stapler.

BACKGROUND OF THE INVENTION

The present invention includes an improved design for lateral positioning of the stapler body over the anvil. U.S. Pat. No. 2,218,794 (Kilbride) shows a raising spring that operates exclusively for that function, with the body positioned laterally over the anvil in the conventional way using sidewalls of the base as "bearings." U.S. patent application Ser. No. 10/443,854, filed May 23, 2003 by J. Marks for a "Spring Energized Desktop Stapler," whose contents are hereby incorporated by reference, discloses a spacer spring that is stiff in the lateral direction to engage the staple track. The spring provides a forward point for lateral positioning of the track over the anvil by engaging the track. The rear area for such positioning is provided at the hinge connection point between the body and the base. Therefore, the moment arm to position the track laterally is the distance from the tip of the spacer spring, tab 54 fitted in opening 84 of the track, to the hinge connection. The moment arm includes a linkage from the track to the body since the track is mounted in the body. Therefore, the lateral stiffness of the assembly depends on the how rigidly the track is connected to the body. If the track is loose in the body such that it can move sideways in chamber 144 then the utility of a good connection between forward tab 54 and opening 84 is compromised.

A further improvement of the present invention is an automatic opening mechanism for the staple-loading track. In U.S. Pat. No. 5,765,742 (Marks) and application Ser. No. 10/443,854 (Marks), a track chamber includes an elongated cavity exposed at the bottom of the stapler body. The chamber is exposed by pulling a staple track rearward, normally with the stapler oriented upside down so the chamber is exposed upward. In the cited art, a track pull includes extended arms that are squeezed together to release track pull latches. In application '854, the procedure to expose the chamber for loading staples includes three steps: pivot the body up and around the base until the body is upside down, squeeze the arms of the track pull, and pull the track out. Staples are loaded pointing upward, toward the exposed direction of the chamber and pointing away from ceiling 142 of the chamber.

U.S. Pat. No. 4,666,075 (Olesen) shows a traditional stapler track chamber. The body pivots about the base while the staple chamber or track remains over the base. The chamber is exposed in the upward direction. Staples are loaded pointing downward with the points against the "staple stick support bottom 21".

In a spring powered desktop stapler, one mode of operation includes firing without staples in the chamber. This mode may be called "dry fire." The striker usually stops near flush with the bottom of the stapler body when a staple is in the chamber and is installed. However, the striker should travel slightly past that position to allow an energy absorbing motion during dry fire. The bottom of the striker can strike parts of the staple-forming anvil in this case. If the bottom of the striker is straight in the conventional way, it could hit the anvil at both the center and the edges of the striker width.

An even worse shape for a desktop stapler striker is shown in U.S. Pat. No. 4,811,884 (Sato). Projections 85, FIG. 19*a*, are intended to press the staple edges. This design is well known in staple guns. However, in a desktop stapler, such projections would hit the anvil even if the striker did not project past the stapler bottom thus damaging the impacting components.

SUMMARY OF THE INVENTION

The present invention is directed to a spring-actuated desktop stapler that in various embodiments relates to an improved staple track and staple ejection features. In one embodiment, lateral positioning is achieved by a moment arm acting upon a single element of the stapler. This element includes the combination of the track and the track pull that is attached securely to the track. The forward point is at tab 54, the distal end of spacer spring 52, and respective opening 84. The rear point is at the contact between the track pull and walls of the base. Since the track with pull assembly is a single rigid structure with respect to the lateral forces involved, the track is held directly laterally over the base. No other relatively movable element of the stapler is part of the moment arm.

For the staple loading operation, the present invention provides an automatic track opening function. During the initial motion of pivoting the stapler body about the base, ribs in the base sidewalls press the latching arms of the track pull. As the body swings away from the base the ribs make an arcuate motion relative to the stapler body. The ribs squeeze and pull the latching arms a short distance so that the track is released from the body and moved rearward. In one embodiment, the same ribs provide both squeezing and pulling action. In another embodiment, one rib set creates the squeezing action while an adjacent rib set provides the pulling action.

The automatic opening feature is convenient since it removes one full step in the staple loading process, and a portion of the next step. The first step would include locating and squeezing the latching arms with the user's fingers. The second step is to slide out the track. With the automatic opening operation the user finds the track in a partially out position just from opening the stapler body for loading. It is merely needed to contact any part of the track or track pull and urge it outward. The track moves farther out if there are staples on the track under the urging of the pusher. The pusher is stationary in relation to the body. The track moves rearward until the pusher is flush with the front of the track. With a full rack, the track springs out to its most rearward position. With no staples on the track, it moves about ½ inch rearward as the stapler is opened.

A further function and advantage of the automatic opening is to prevent unintended operation when the stapler is swung to its open position, where the staples point upward and the base is not present to stop an ejecting staple. With the track sprung out under the urging of the pusher spring as discussed above, the pusher spring has no energy left to urge the staples into the path of the striker. Therefore, operating the mechanism of an opened stapler results in a safe dry fire. If it is desired to use the stapler of the invention as a tacker—installing staples into a board for example—a user would push the track back into its operative position with the base still opened.

Another feature of the invention is a non-straight bottom edge on the striker. The lower edge is preferably shaped to allow the striker to project past the bottom of the stapler body while remaining clear of the anvil. The lower corners of the striker are radiused to correspond to the opposing radii of the bends in the staple wire. The striker still contacts the entire top of a staple while the reduced corners provide clearance for the anvil. A recess in the center of the striker edge provides further clearance for the raised center of the anvil.

A further feature of the invention is a staple exit rib. This includes ribs at the front of the staple chamber that partially enclose the chamber. In prior art bottom loading type staplers, the chamber is entirely enclosed at the top and entirely open in the bottom. A staple jam is accessed by pulling the track out in this type of stapler. In the present invention, the exit ribs partially enclose the bottom to form a slot through which only a single staple can be ejected at one time. In the case of certain staple jams, this prevents multiple staples from being ejected together. The features of the invention may be used for a spring-actuated stapler as well as for a direct acting standard stapler.

These and other features and advantages of the invention will become apparent from the following detailed description when taken in conjunction with the accompanying exemplary drawings.

BRIEF DESCRIPTION OF THE DRAWINGS

FIG. 1 is a side elevational view of a desktop stapler according to one embodiment of the invention, with track opening features shown in hidden view.

FIG. 1*a* is a cross sectional view of the track opening features taken along line 1*a*—1*a* of FIG. 1.

FIG. 2 is the stapler of FIG. 1, opened farther than that shown in FIG. 1.

FIG. 2*a* is a cross sectional view of the track opening features taken along lines 2*a*—2*a* of FIG. 2, with the track pull being deflected to a released condition.

FIG. 3 is a side and slightly top perspective view of a stapler with automatic opening features in a fully open position, with the track in its opened condition.

FIG. 4 is a side and slightly top perspective view of a prior art stapler without automatic opening features.

FIG. 5 is a top/side perspective view of a stapler base and cover plate assembly.

FIG. 6 is a cross sectional view, similar to the cross sectional view of FIG. 2*a*, but with separate pulling ribs included in the base.

FIG. 7 is a rear/side perspective view of a stapler.

FIG. 8 is a detailed, partial view of FIG. 7, showing a track pull adjacent to a sidewall of the base.

FIG. 9 is a bottom view of a track and track pull assembly, with a cover plate spring in cut-away view.

FIG. 10 is a side/front perspective view of a desktop stapler in a normal closed position.

FIG. 11 is the stapler of FIG. 10 with the striker in hidden view and the base removed from view.

FIG. 12 is a cross sectional view of FIG. 11, showing only the cover plate and the striker.

FIG. 13 is a detailed partial view of FIG. 12, showing a striker bottom edge against a staple.

DETAILED DESCRIPTION OF THE PREFERRED EMBODIMENTS

Figures 14, 15:
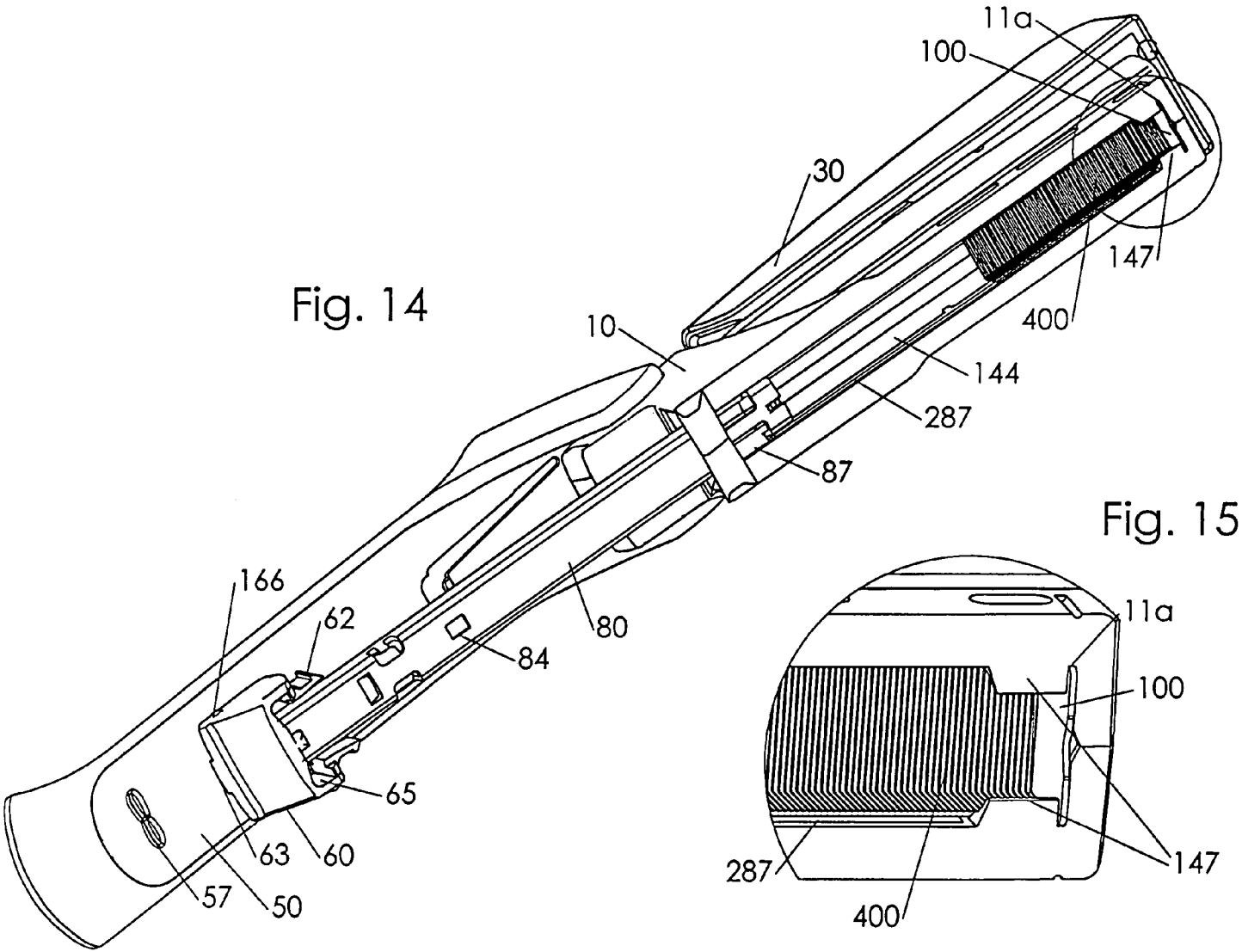
FIG. 14 is a top perspective view of a stapler in a fully open position showing staple exit ribs.
FIG. 15 is a detailed, partial view of the stapler of FIG. 14.

The present invention in various exemplary embodiments is directed to a spring-actuated desktop stapler and more specifically relates to an improved staple track and staple ejection features that provide advantages over the prior art. In such a spring-actuated stapler, the striker is energized and actuated by the potential energy stored in a spring, rather than from inertia generated by a user pushing down on the actuation handle in a conventional stapler. In one version of a spring-actuated desktop stapler, pressing down on the actuation handle lifts the striker upward against the bias of a power spring. When the striker is lifted past a certain point, it is released from the handle and the power spring accelerates the striker downward into a staple which upon impact is ejected from the stapler.

In another version of a spring-actuated stapler, the striker has a rest position above the staple track rather than in front of the staple track. Pressing the actuation handle energizes a spring that is linked to the striker. The striker is released at a predetermined position of the handle and the striker moves down to eject a staple. In the reset action, the assembly of the handle, striker, and spring all move upward together to the rest position.

Although the following exemplary embodiments of the present invention are described in connection with a spring-actuated stapler, it is contemplated that the present invention can also be applied to a conventional stapler.

FIGS. 1 and 2 are perspective views of one embodiment. Handle 30 pivots about body 10 to a lower handle position (not shown) in an actuation stroke. Body 10 pivots about base 20 from the lower body position of FIG. 10, through the intermediate positions of FIGS. 1 and 2, to the fully open position of FIG. 3. A further position (not shown) includes body 10 pivoted to a lowest position where the body front lower end with striker 100, FIG. 11, presses atop a stack of papers (not shown) so that the papers are squeezed between body 10 and cover plate 50 at anvil 57. The lowest body position is normally lower than that of FIGS. 10 and 11; in this body position the body is next to anvil 57, separated by the thickness of the papers, and a staple is ejected to fasten the papers together.

FIGS. 1 and 2 show the initial steps of automatically opening the track. FIGS. 3 to 5 further illustrate the structures described below. In FIG. 1, recess 127, rib 128, and track pull 60 are hidden inside sidewalls 23 of base 20 and indicated by dashed lines. FIG. 5 provides a better view of recess 127 and rib 128 within base 20. As body 10 is rotated upward, bumps 165 of track pull 60 are in recess 127 and approach contact with rib 128 through an arcuate motion. The respective positions are seen in the cross sectional view of FIG. 1*a*. Track pull arm 65 is an integral extension of track pull 60 and is resiliently movable with respect to track pull 60. Arm 65 extends from arm attaching area 64 as seen in FIGS. 1*a* and 2*a*. Rib 128 presses arm 65 at a position between attaching area 64 and the distal end of arm 65.

Track pull 60 is securely attached to track 80. Track lock 62 of the track pull engages catch 262 of housing 10. Body 10 is rotated farther upward in FIG. 2. In FIG. 2*a* it is seen that track pull 60 has moved forward in base 20 so that rib 128 is pressing bump 165. Rib 128 is a relatively rigid part of base 20, so resilient arm 65 is forced to deflect inward. Rib 128 essentially functions as a de-latching rib. Track lock 62 is at the distal end of arm 65 so the track lock 62 also moves inward to disengage catch 262, as depicted by a gap therebetween in FIG. 2*a*. Further rotating body 10 upward drags track pull 60 rearward from the friction of engagement between rib 128 and bump 165.

Alternatively, if desired another rib 129 may be added to more forcefully pull the track out at the stage of FIG. 2, as shown in FIG. 6. Drag rib 129 provides a solid engagement with tab 61 of track pull 60 to pull the track out. Drag rib 129 engages tab 61 when ribs 128 have caused track lock 62 to disengage catch 262 as discussed for FIG. 2*a*. The front side of drag rib 129, face 129*a*, is preferably angled so that tab 61 can move behind drag rib 129 when body 10 is replaced to its normal position over base 20. In this operation, track pull 60 moves rearward into place, to the left in FIG. 6. Sidewalls 23 of base 20 may be forced apart by the effect of angled face 129*a* to allow passage of tab 61, since track pull 60 is not normally flexible in this area.

One reason it may be desired to use a secondary pulling method is if bump 165 arcs out of contact with rib 128 after the track pull is released but before rib 128 can adequately pull the track outward. For example, in FIG. 1, rib 128 could include only the portion below the section line 1*a*. As bump 165 arcs upward it loses contact with the exemplary shorter rib 128, in this example just at the position of FIG. 2*a*. The track is disengaged at track lock 62 and catch 262, but cannot be pulled out by shorter rib 128, which is now out of contact. Then tab 61 engages drag rib 129 as shown in FIG. 6. The track is pulled out.

From the position of FIG. 2, the stapler is pivoted fully opened to the position shown in FIG. 3. Body 10 extends rearward and is upside down, and track pull 60 with track 80 extends rearward. Track lock 62 is visible and clearly not engaged. A user need only slide the track farther outward by urging the track in any way to the rear to release the track 80 from the stapler 10. The track pull 60 need not be squeezed in a precise way, nor squeezed at all to release the track.

FIG. 4 shows a typical prior art stapler without the automatic opening feature of the present invention. There is no bump 165, rib 128, or recess 127. The track assembly including track pull 60*a* and track 80 remains in the inward latched track position. In this case a user must locate and squeeze the track pull in the correct way and pull track 80 straight out from its fully in position.

In the above description, the various features of the track pull and base are referenced in singular. However, it is contemplated that in FIGS. 1*a*, 2*a*, and 6 the track locking function is provided preferably by symmetrical sets or pairs of features, such as ribs and catches.

Another feature of the invention is an improved alignment system as best seen in FIGS. 5–11. The track is directly or nearly directly contacted by the base to hold the track in lateral alignment over the anvil of the base. Anvil alignment is important when the stapler is in its lowest position upon a stack of papers. A misalignment could cause the legs of the just-ejected staple not to properly curl against the anvil 57 under the stack of stapled papers. Text As seen in FIGS. 6 and 7, track pull 60 is rigidly assembled to track 80, and track pull 60 includes extensions 166 that contact sidewalls 23 of base 20. Tab 54 at the distal end of spacer spring 52 slidably fits into opening 84 of track 80, as shown in FIG. 9. The fitment is preferably close in the lateral direction; just enough lateral clearance that the tab 54 can slide longitudinally in the opening 84. Spacer spring 52 is rigidly attached to cover plate 50, as in FIGS. 5 and 11. The rigid attachment describes the lateral movement of spacer spring 52 (i.e., in the vertical direction in FIG. 9) while spacer spring 52 is resilient or flexible when moved in a direction perpendicular to the thickness of the spring (i.e., in the vertical direction in FIG. 11).

In FIGS. 9 and 11 there is specified a "torque arm," and in FIG. 9 the drawing is labeled with "freeplay." The torque arm is the distance wherein the combined track 80 and track pull 60 or "track assembly" is held laterally in the assembly of cover plate 50 and base 20 shown in FIG. 5. Hinge connection 22 is preferably not a primary means to laterally position the body over the anvil.

The torque arm is present when the stapler is in its closed position or lowest position, wherein the rear end of the track assembly may contact or be confined by the base 20. Cover plate 50 is securely assembled to base 20 so that these two elements will not move with respect to each other. The assembly of cover plate 50 and base 20 may be referred to as simply base 20 in describing the torque arm. The lateral link created by tab 54 situated in opening 84 is a front torque arm contact. Other equivalent linking structures include a slot, notch, or groove at the distal end of spacer spring 52, and a tab, hook, or stop extending from track 80.

The rear contact of the torque arm is preferably between sidewalls 23 and laterally facing extension 166. Preferably, track pull 60 cannot move laterally in base 20 (i.e., in the vertical direction in FIG. 9). Note that extensions 166 are optionally fitted to track pull 60 as rearward as practical, near the stiff rear end of the track pull 60, as best seen in FIG. 3. This contrasts with the position of bumps 165 which are located on resilient arms 65. With extensions 166 being rigid parts of track pull 60, the track assembly will be held rigidly in the lateral direction to base 20. Of course it is not required that there be extensions 166 to contact sidewalls 23. There may be extensions from the sidewalls instead. Or there may be just contact at flat surfaces. Extensions are convenient to easily define the dimensions at the contact area.

Another way to directly link track 80 to base 20 is through a rearward-facing surface of track pull 60 or track assembly. A rib or tab extends from the rear of the track assembly into a slot of the base. Or equivalently, the rib and slot positions are reversed. Tab 68 of FIG. 9 fits into slot 168 in base 20 of FIG. 5. So when body 10 is closed over base 20, tab 68 enters slot 168. Tab 68 fits snugly into slot 168 so that the rear end of track 80 preferably cannot move laterally with respect to base 20. A further option is an extension of track 80 exposed through an opening of track pull 60, at the rear of track pull 60. This would be equivalent in function to tab 68 of the track pull. These features may be used along with extensions 166 against sidewalls 23 to provide two direct lateral positioning link paths between the rear of track 80 and base 20 to form the rear contact for the torque arm.

Optionally, base 20 or cover plate 50 may contact the rear end of track 80 directly to form the rear contact of the torque arm. In this embodiment (not shown), the "track assembly" would not need to include the track pull for the purpose of linking the rear of track 80 to the base 20, and the "rear end" of the track assembly would be the rear end of the track.

An indirect method may be used to form the rear torque arm contact. Body 10 may include extensions 226, as seen in FIGS. 3 and 8. Extensions 226 contact sidewalls 23 in the same manner as extensions 166 discussed above. To provide the rear contact of the torque arm in this configuration, body 10 is preferably closely linked to track 80 or track pull 60. Tab 63 of track pull 60, shown in FIGS. 7 and 9, engages a slot (not shown) in body 10. Therefore, track pull 60 is limited in moving laterally against body 10. However, if there is freeplay in the fitment of tab 63, the freeplay reduces the rigidity of the rear torque arm contact since the link between the track assembly and sidewalls 23 is indirect.

In summary, one effect of the rear torque arm contact is to create a rigid lateral link (vertical direction in FIG. 9) between base 20 and the rear of track 80, where track 80 is slidably fitted to body 10.

With the torque arm as shown, there is preferably very little freeplay at the front of track 80. Therefore, the track front end stays closely aligned over anvil 57 (mostly in and out of the page in FIG. 11). The position of track 80 is the primary determinate of the alignment of staples over anvil 57 since the staples are guided by track 80. Body 10 is aligned through its fitment around track feet 87. Track feet 87 preferably fit into channels 287 of body 10 (FIGS. 14 and 15) closely such that track 80 may slide in body 10 but does not rattle within body 10 (i.e., in the vertical direction in FIG. 9). As a result, body 10 is positioned fairly precisely over anvil 57 and misalignments are minimized.

It is desirable that the torque arm be as long as possible. For example, spacer spring 52 may be extended farther forward along with repositioning opening 84 of track 80 farther forward to lengthen the torque arm. For the same effect, extensions 166 of one embodiment of the rear contact area are positioned near the rear-most possible laterally facing position on the track/pull assembly.

A further feature of a preferred embodiment of the invention is a striker bottom edge that is contoured to approximately follow the shape of the anvil. In FIGS. 11 to 13, a preferred embodiment of the striker is shown. Anvil 57 serves to form the legs of a staple around the back of a stack of papers to be fastened. Anvil 57 includes a curved shape formed by center ridge 57*a*, well 57*b*, and side ramps 57*c*, as seen in FIG. 12. Generally speaking, anvil 57 is a recess formed into the surrounding material of cover plate 50. The anvil is preferably a particular shape to properly form a staple. One preferred embodiment has ramps 57*c* that are aligned with the side edges of striker 100 as shown in FIG. 12. Ridge 57*a* forms the wire up into the back side of the paper, especially when only a few sheets are being fastened.

During a "dry fire" without staples, striker 100 normally protrudes past the bottom of body 10 and into anvil 57, as shown in FIG. 12. Corners 107 of striker 100 are very near to ramps 57*c*. Note that corners 107 are optionally rounded to provide extra clearance to anvil 57. In FIG. 13, corners 107 are rounded in a manner similar to staple outer corners 401 of staple 400.

These rounded corners 107 are opposite to the extended tabs shown in U.S. Pat. No. 4,811,884 (Sato) for example. In Sato '884, it is intended that the protruding tabs help to surround the top of the staple at outer corners 401. However, it is more typical in conventional staplers and staple guns that the bottom of the striker is entirely flat; this does not cause any ill effect. Staple 400 includes a flat, straight wire section 406, dropping off into the curves of corners 401. This is typical for all staples including those pressed by straight-bottomed strikers. Therefore, a striker works well as long as it contacts a staple along all of the outer portions of straight wire section 406. Pressing the center of the staple is not necessary as it merely bends the wire.

Centrally positioned notch 101 provides clearance for anvil ridge 57*a*. Notch 101 has virtually no effect on driving the staple since a staple is typically driven by pressing near its legs.

Striker 100 preferably has straight bottom edge 106 that contacts straight wire section 406 up to outer corners 401. As outer corners 401 curve down, striker corners 107 curve upward equivalently, each respective curve starting near the same position. Striker 100 thus presses staple 400 along essentially the entire practical top surface of staple 400. As discussed above, curved corners 107 of striker 100 provide clearance for anvil ramps 57*c*. It may be desired to make the striker wider than the staple (i.e., in the horizontal direction in FIG. 13). However, striker corners 107 should start the curve at the same position over the staple since the position of ramp 57*c*, which the corners must clear, is determined by the width of staple 400, not the width of striker 100.

Striker 100 includes optional holes 102 to fit a power spring (not shown) that biases and drives striker 100 downward in an actuation stroke. Optional slot 108 receives a lever (not shown) that lifts striker 100 as part of the actuation stroke to energize the power spring. Striker 100 moves up and down (vertically in FIGS. 11 to 13) between a highest position within body 10 and a lowest position adjacent to anvil 57. More details regarding the lever and power spring are disclosed in U.S. application Ser. No. 10/443,854 (Marks), whose contents are hereby incorporated by reference.

Another feature of the invention includes staple exit ribs 147, shown in the top views FIGS. 14 and 15. A rack of staples 400 fits in staple chamber 144 of body 10. Chamber 144 has a ceiling enclosing its top and is open along its bottom as shown in FIG. 14. Track 80 holds staples 400 with the staple points facing toward the open bottom of chamber 144. Track 80 is normally in an inward latched position, as in FIG. 4. Body 10 is normally oriented upside down when the stapler is in the fully open position to allow staples 400 to be loaded into staple chamber 144. Of course, a user may hold the stapler in other positions when it is fully open; the term upside down is used for convenient reference relative to the stapler's normal upright position on a table or desktop.

As seen in FIGS. 14–15, striker 100 slidably fits at the front of chamber 144 within slot 11*a* of body 10. Other portions of slot 11*a* within body 10 (not shown) guide the movement of striker 100 when the striker is in its raised position.

If a jam occurs, it may be necessary to pull track 80 out from chamber 144, possibly forcefully, to allow track 80 or the track assembly to be moved to its rearward extended position as shown in FIG. 14. Under certain circumstances, it is possible that striker 100 is situated in its upper position with the power spring energized. It is further possible that striker 100 may remain jammed until track 80 has been pulled back the distance of several staples along the rack of staples 400. Then a group of staples 400 could possibly be ejected out of chamber 144 suddenly. To prevent such an incident, a pair of flap-like ribs 147 enclose the front portion of chamber 144 to partially surround all of the front several staples from under the staple points. It is then impossible for a group of staples to be ejected together. Only the lead staple that has advanced into the striker slot 11*a* can be ejected by the striker 100 impact. Optionally, exit ribs 147 may extend to meet each other to fully surround the front several staples 400 of the rack from under the staple points. To load staples 400 in the presence of exit ribs 147, the rack of staples 400 is lowered into chamber 144 front first, slid under exit ribs 147 up to striker 100, and then lowered at the rear of the rack. This procedure is a normal sequence in any case, so the presence of exit ribs 147 does not require a departure from that normal loading procedure.

From the foregoing detailed description, it should be evident that there are a number of changes, adaptations and modifications of the present invention that come within the province of those skilled in the art. However, it is intended that all such variations not departing from the spirit of the invention be considered as within the scope thereof as limited solely by the following claims.

I claim:

1. A desktop stapler comprising:

an elongated base;

a body pivotably attached to the base toward a rear end of the base, the body including means for ejecting staples;

an anvil disposed at the front end of the base for receiving the ejected staples;

a cantilevered spacer spring extending from the rear end of the base and having a tab at a free distal end; and a track assembly fitted to the body underneath the means for ejecting staples and having an opening, wherein the tab of the spacer spring engages the opening with a tight lateral fit so that the front of the track assembly is substantially aligned over the anvil;

wherein the track assembly further includes a track pull having a resilient latch arm that releasably engages the track assembly to the body, and a de-latching rib disposed within the sidewalls of the base, wherein the de-latching rib deflects the resilient latch arm when the body is pivoted against the base.

2. A desktop stapler comprising:

an elongated base;

a body pivotably attached to the base toward a rear end of the base having a lowest stapler position wherein the base and the body extend forward from the pivotal attachment between the base and the body, and having a body front lower end positioned proximate to and substantially aligned with an anvil;

wherein the base includes a spacer spring, and the spacer spring includes a tab at a distal end of the spacer spring;

a track assembly fitted to the body, including a track extending in a direction of the elongated base when the body is in the lowest stapler position, and wherein the track includes an opening, the tab of the spacer spring fits closely in a lateral direction and is slidable in a longitudinal direction in the track opening;

a front torque arm contact defined by the link between the tab and the track opening;

a rear end of the track assembly positioned rearward of the opening in the track;

a rear torque arm contact defined by the rear end of the track assembly contacting the base to form a direct lateral link between the track assembly and the base; and wherein the torque arm acting upon the track holds a front end of the track substantially aligned laterally over the anvil.

3. The desktop stapler of claim 2, wherein the track assembly includes a track pull at a rear of the track assembly, and the track pull is rigidly attached to the track and fits between the sidewalls of the base, wherein the rear torque arm contact is located between the sidewalls of the base and the track pull.

4. The desktop stapler of claim 3, wherein the rear torque arm contact is located on lateral extensions of the track pull, the lateral extensions being on a rear most position of the track assembly.

5. The desktop stapler of claim 3, wherein the rear torque arm contact is between a rearward extending tab of the track assembly and a slot of the base.

6. A desktop stapler comprising:

an elongated base;

a body pivotably attached to the base toward a rear end of the stapler having a closed stapler position wherein the body extends forward from the pivotal attachment in a substantially parallel relationship with the base, a fully open position of the stapler wherein the body extends rearward from the pivotal attachment and is upside down, an intermediate position of the stapler wherein the body is pivoted upward from the base;

a track assembly slidably fitted to the body including an inward latched track position under the body and an outward extending open track position, the track assembly including a track pull, the track pull including a resilient latch arm that engages the track assembly to the body to hold the track assembly in the inward latched track position; and a de-latching rib disposed in the sidewalls of the base, wherein the de-latching rib presses the resilient latch arm when the stapler is in the intermediate stapler position, the resilient latch arm thereby being disengaged from the body.

7. The desktop stapler of claim 6, wherein the base pulls the track assembly toward the outward extending open track position as the body is rotated from the intermediate stapler position toward the fully open stapler position.

8. The desktop stapler of claim 7, wherein a second rib of the base pulls the track pull and the track assembly toward the outward extending open track position.

9. The desktop stapler of claim 6, wherein the de-latching rib is adjacent to a recess in the sidewalls of the base, and the track pull includes a bump on the latch arm that is pressed by the de-latching ribs, the bump extending into the recess when the stapler is in the closed stapler position.

10. The desktop stapler of claim 6, wherein the resilient latch arm is attached to the track pull at an arm attaching area, the arm includes a track lock at a distal end of the arm, and the de-latching rib presses the arm at a position of the arm between the arm attaching area and the distal end of the arm.

11. A desktop stapler comprising:

a body;

a staple track extending from a front to a rear of the body within a staple chamber, wherein the staple chamber includes an elongated cavity exposed at a bottom of the body and a ceiling enclosing a top of the staple chamber;

a striker at the front of the staple chamber;

wherein the staple track is slidably fitted within the staple chamber including an inward latched track position and a rearward extended track position, the track holding staples with the staples pointing toward the bottom of the body when the track is in the inward latched position;

exit ribs at the bottom of the body at least partially enclosing a front portion of the staple chamber with a striker slot being in front of the exit ribs.

12. The desktop stapler of claim 11, wherein the exit ribs entirely enclose the front portion of the chamber from under the staple track.

13. The desktop stapler of claim 11, wherein the exit ribs include a mirror image, flap-like shape.

14. A desktop stapler comprising:

an elongated base;

a body pivotably attached to the base toward a rear end of the base, the body including means for ejecting staples;

an anvil disposed at the front end of the base for receiving the ejected staples;

a cantilevered spacer spring extending from the rear end of the base and having a tab at a free distal end; and a track assembly fitted to the body underneath the means for ejecting staples and having an opening, wherein the tab of the spacer spring engages the opening with a tight lateral fit so that the front of the track assembly is substantially aligned over the anvil.

15. A desktop stapler comprising:

an elongated base;

a body pivotably attached to the base toward a rear end of the stapler, the stapler having a closed stapler position wherein the body extends forward from the pivotal attachment in a substantially parallel relationship with the base, and an intermediate stapler position wherein the body is pivoted away from the base;

a striker slidably disposed at a front interior of the body;

a handle for actuating the striker; and a track assembly slidably fitted to a bottom of the body, wherein in the stapler closed position the base confines the track assembly to be immediately adjacent the striker, and wherein in the intermediate stapler position the track assembly is moved rearward away from the striker so that the track assembly extends rearward from the body and is at least partially exposed.

16. The stapler of claim 15, wherein in the stapler closed position the base confines the track assembly such that the staple track is latched to the body.

17. The stapler of claim 15, wherein a track chamber is at least partially exposed at a bottom of the body when the track assembly is moved rearward.

18. The stapler of claim 15, wherein the track assembly includes a track pull, the base includes sidewalls, and the sidewalls surround the track pull in the closed stapler position.

19. The stapler of claim 18, wherein the pivotal attachment is immediately above the track pull.

20. A desktop stapler comprising:

an elongated base including sidewalls;

a body pivotably attached to the base toward a rear end of the stapler, the stapler having a closed stapler position wherein the body extends forward from the pivotal attachment in a substantially parallel relationship with the base, and an open position of the stapler wherein the body is pivoted away from the base;

a track assembly including a track pull disposed at a bottom of the body, wherein the base sidewalls surround the track pull in the closed stapler position; and wherein the track assembly is slidably fitted to the body having an inward track position with the track assembly under the body, and movable to extend rearward from the body in the open position of the stapler so that the track pull extends beyond the base sidewalls to be exposed outside the base sidewalls.

21. The stapler of claim 20, wherein a track chamber is at least partially exposed when the track assembly is moved rearward.

* * * * *